US009062458B2

(12) United States Patent
Berrian

(10) Patent No.: US 9,062,458 B2
(45) Date of Patent: Jun. 23, 2015

(54) MATERIAL REMOVAL TOOL

(71) Applicant: Berrian Ruble LLC, Pacolet, SC (US)

(72) Inventor: Daniel Scott Berrian, Pacolet, SC (US)

(73) Assignee: BERRIAN RUBLE LLC, Pacolet, SC (US)

( * ) Notice: Subject to any disclaimer, the term of this patent is extended or adjusted under 35 U.S.C. 154(b) by 271 days.

(21) Appl. No.: 13/862,827

(22) Filed: Apr. 15, 2013

(65) Prior Publication Data

US 2014/0305263 A1 Oct. 16, 2014

(51) Int. Cl.

| | |
|---|---|
| ***E04D 15/00*** | (2006.01) |
| ***E04G 23/00*** | (2006.01) |
| ***E04D 15/02*** | (2006.01) |
| *B25B 33/00* | (2006.01) |
| *B25C 11/00* | (2006.01) |

(52) U.S. Cl.

CPC ..... *E04D 15/003* (2013.01); *B25B 33/00* (2013.01); *B25C 11/00* (2013.01); *E04G 23/006* (2013.01); *E04D 15/02* (2013.01)

(58) Field of Classification Search

CPC ..... E04D 15/003; E04D 15/02; E04G 23/006; B25B 33/00; B25C 11/00

USPC ..... 81/45

See application file for complete search history.

(56) References Cited

U.S. PATENT DOCUMENTS

| | | | | |
|---|---|---|---|---|
| 4,477,972 | A * | 10/1984 | Testa, Jr. | 30/172 |
| 4,663,995 | A * | 5/1987 | Amundson et al. | 81/45 |
| 4,691,439 | A | 9/1987 | Marra | |
| 4,709,479 | A * | 12/1987 | Lavelette | 30/170 |
| 4,858,503 | A * | 8/1989 | Dike, Jr. | 81/45 |
| 5,001,946 | A * | 3/1991 | Shirlin et al. | 81/45 |
| 5,741,047 | A | 4/1998 | Ordonez | |
| 5,863,100 | A | 1/1999 | Martin | |
| 5,906,145 | A | 5/1999 | Shepherd | |
| 5,988,021 | A | 11/1999 | Nicolosi et al. | |
| 6,095,015 | A | 8/2000 | Phelan | |
| 6,116,117 | A * | 9/2000 | Nicolosi et al. | 81/45 |
| 6,128,979 | A * | 10/2000 | Shepherd | 81/45 |
| 6,467,377 | B1 | 10/2002 | Kersting | |
| 6,711,971 | B1 | 3/2004 | Morin | |
| 7,222,556 | B2 | 5/2007 | Tyler | |
| 7,318,364 | B1 | 1/2008 | Nickolas | |
| 7,373,859 | B1 * | 5/2008 | Shirlin et al. | 81/45 |
| 7,401,861 | B2 | 7/2008 | Purcell et al. | |
| 7,520,197 | B2 | 4/2009 | Kingham | |
| 7,992,467 | B2 | 8/2011 | Becoat | |
| 8,056,444 | B1 | 11/2011 | Van Straten et al. | |
| 2006/0156866 | A1 | 7/2006 | Ingell | |
| 2009/0188350 | A1 * | 7/2009 | Becoat | 81/45 |
| 2009/0199508 | A1 | 8/2009 | Fairris | |

* cited by examiner

*Primary Examiner* — Monica Carter
*Assistant Examiner* — Danny Hong
(74) *Attorney, Agent, or Firm* — Dority & Manning, P.A.

(57) ABSTRACT

A material removal tool is provided. The material removal tool includes a handle that defines a chamber. A linear actuating mechanism is positioned within the chamber of the handle. A blade is rotatable or pivotable relative to the handle. The blade and linear actuating mechanism are coupled together such that the linear actuating mechanism selectively rotates or pivots the blade relative to the handle.

20 Claims, 9 Drawing Sheets

MATERIAL REMOVAL TOOL

FIELD OF THE INVENTION

The present subject matter relates generally to tools for removing material from surfaces, such as shingles from roofs.

BACKGROUND OF THE INVENTION

Removing shingles from roofs is a notoriously difficult task. Generally, laborers use shovels and other simple tools to manually pry shingles away from a roof. After removing the old shingles, the laborers set or pull any associated nails in order to provide a relatively flat surface for applying new shingles. Such procedures can be tedious, time consuming, labor intensive, and hazardous. In particular, certain roofs occupy large areas, and manually removing shingles from such roofs can consume large amounts of valuable time and/or requires large numbers of laborers to complete quickly. However, employing large numbers of laborers can be prohibitively expensive due to the high cost of worker's compensation insurance associated with such work. Various factors contribute to the high cost of worker's compensation insurance for roofers. As one example, manually removing shingles from roofs commonly leads to certain injuries, such as back injuries. In particular, repeatedly bending over and/or prying shingles loose with shovels can lead to painful and expensive back injuries.

Certain tools are available for assisting removal of shingles from a roof. However, such tools are generally not available for sale commercially and suffer from various limitations and drawbacks. For example, U.S. Pat. No. 7,401,861 provides an apparatus 1 for removing surface coverings. Apparatus 1 includes an air cylinder 30 that is operable to pivot a blade 70. During operation of apparatus 1, debris removed by blade 70 can impact and damage cylinder 30. Similarly, cylinder 30 is exposed to dirt, dust, and other material that can negatively affect operation of cylinder 30. Cylinder 30 can also be damaged during transportation or storage of apparatus 1. For example, tools, such as apparatus 1, are commonly stored in a truck bed with other tools. Such storage conditions can damage cylinder 30, e.g., due to contact with other tools or materials.

As another example, U.S. Pat. No. 5,906,145 provides a pneumatically powered shovel 10 for removing shingles. Shovel 10 includes an air hammer 70 that moves a shovel blade 20 of shovel 10 rapidly in a reciprocating motion like a chisel. During operation of shovel 10, air hammer 70 can require an inconveniently large air compressor to operate continuously or even often. Generally, a small, portable air compressor cannot provide sufficient air to operate air hammer 70 continuously or even often. Further, removing nails and other fasteners from a roof can be difficult due to the reciprocating action of shovel blade 20. Such reciprocating action can damage underlying plywood or shear nails and other fasteners secured within the plywood. In addition, the reciprocating action of shovel blade 20 can jar or shake a user of shovel 10 such that it can be difficult for the user to operate shovel 10 for extended periods of time.

As yet another example, U.S. Pat. No. 7,222,556 provides a shingle removing machine 10 with an engine or motor 28 that drives shingle removal blades 48a and 48b. The machine 10 is large, heavy, and cumbersome. Thus, lifting the machine 10 onto a roof can be difficult, and operating machine 10 on smaller roofs can be difficult as well. In addition, machine 10 is complex and includes many moving parts. Replacing such components can be difficult.

BRIEF DESCRIPTION OF THE INVENTION

The present subject matter provides a material removal tool. The material removal tool includes a handle that defines a chamber. A linear actuating mechanism is positioned within the chamber of the handle. A blade is rotatable or pivotable relative to the handle. The blade and linear actuating mechanism are coupled together such that the linear actuating mechanism selectively rotates or pivots the blade relative to the handle. Additional aspects and advantages of the invention will be set forth in part in the following description, or may be apparent from the description, or may be learned through practice of the invention.

In a first exemplary embodiment, a material removal tool is provided. The material removal tool defines a longitudinal direction and a transverse direction. The longitudinal and transverse directions are perpendicular to each other. The material removal tool includes a handle that extends between a first end portion and a second end portion along the longitudinal direction. The handle defines a chamber at the second end portion of the handle. A linear actuating mechanism is positioned within the chamber of the handle. A material engagement assembly is mounted to the handle at the second end portion of the handle. The material engagement assembly includes a blade, a frame, and a hinge that rotatably mounts the blade to the frame such that the blade is rotatable on an axis of rotation. The axis of rotation is substantially parallel to the transverse direction. A cam is rotatably mounted to the frame. A linkage assembly couples the linear actuating mechanism to the cam such that linear motion of the linear actuating mechanism rotates the blade on the axis of rotation.

In a second exemplary embodiment, a material removal tool is provided. The material removal tool defines a longitudinal direction and a transverse direction. The longitudinal and transverse directions are perpendicular to each other. The material removal tool includes a handle that has a first end portion and a second end portion. The first and second end portions of the handle are spaced apart from each other along the longitudinal direction. The handle defines a chamber at the second end portion of the handle. A linear actuating mechanism is positioned within the chamber of the handle. A blade is positioned at the second end portion of the handle. The blade is mounted for pivoting relative to the handle. A cam is positioned at the second end portion of the handle. The cam is rotatable in a plane that is perpendicular to the transverse direction. The cam has a first leg and a second leg that are spaced apart from each other. The first leg of the cam is mounted to the blade. A linkage assembly couples the linear actuating mechanism and the second leg of the cam together such that linear motion of the linear actuating mechanism pivots the blade relative to the handle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
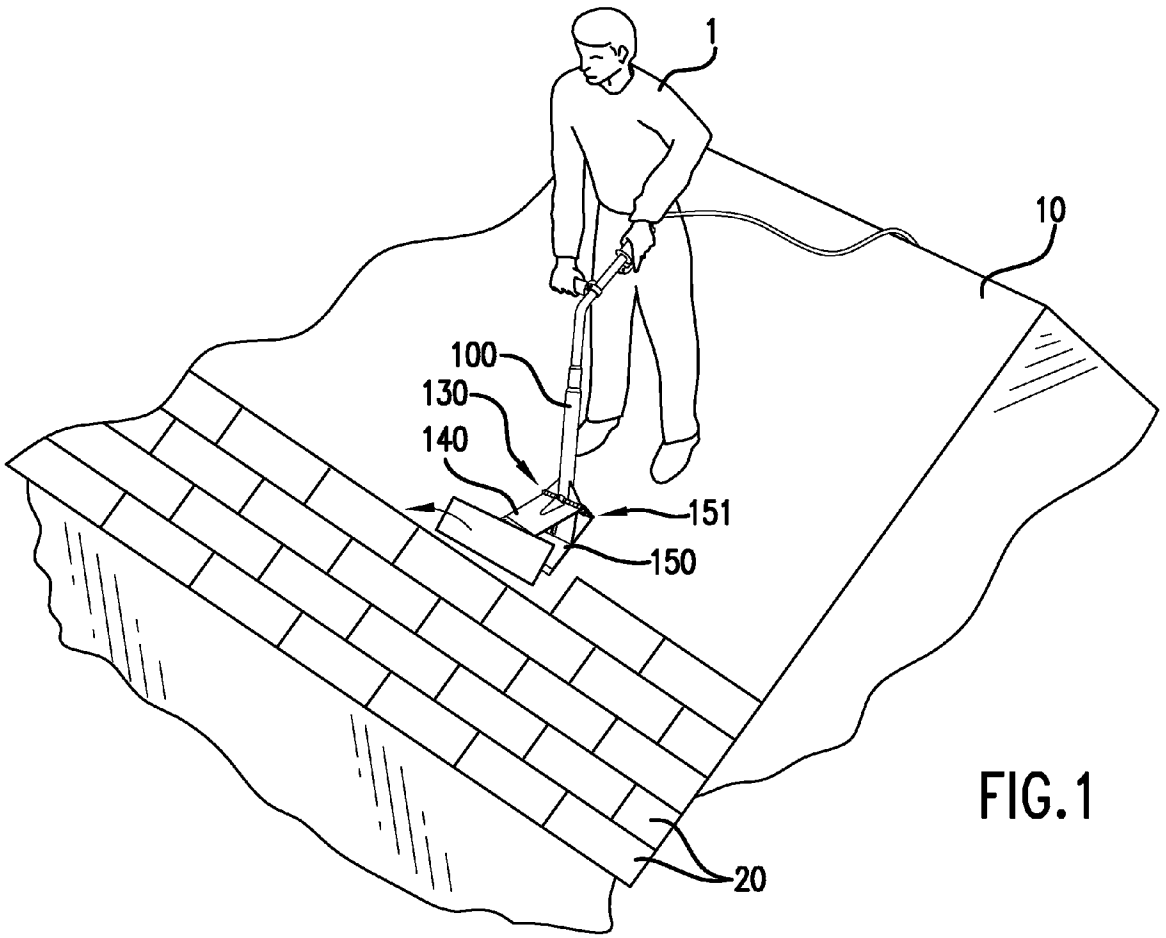
FIG. 1 provides a perspective view of a material removal tool according to an exemplary embodiment of the present subject matter with the exemplary material removal tool being used to remove shingles from a roof.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a material removal tool 100 according to an exemplary embodiment of the present subject matter. In FIG. 1, a user 1 is shown operating material removal tool 100 to remove shingles 20 from a roof 10. Thus, material removal tool 100 can assist user 1 with removing shingles 20 from roof 10. However, it should be understood that material removal tool 100 is not limited to assisting user 1 with removing shingles 20 from roof 10 and can be used for any other suitable purpose. For example, material removal tool 100 may be used to assist a user with removing flooring (not shown), such as carpet, tile, or wood flooring.

Figure 2:
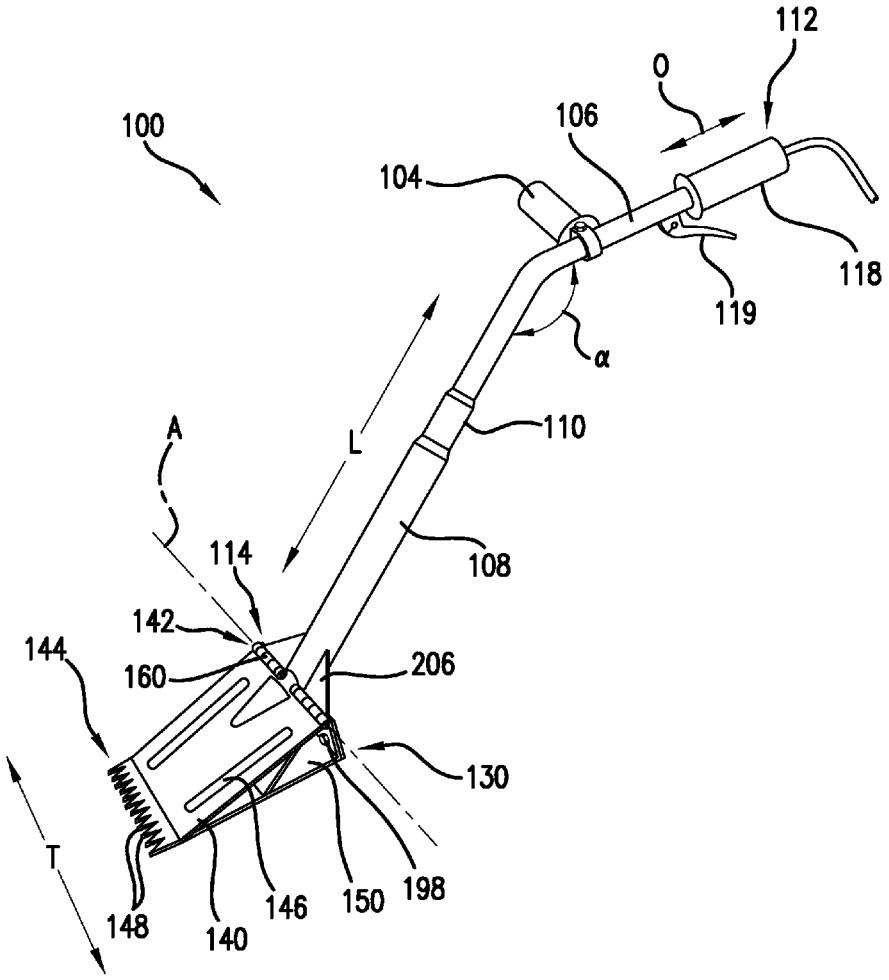
FIG. 2 provides a perspective view of the exemplary material removal tool of FIG. 1 with a blade of the exemplary material removal tool shown in a lowered position.
Figure 3:
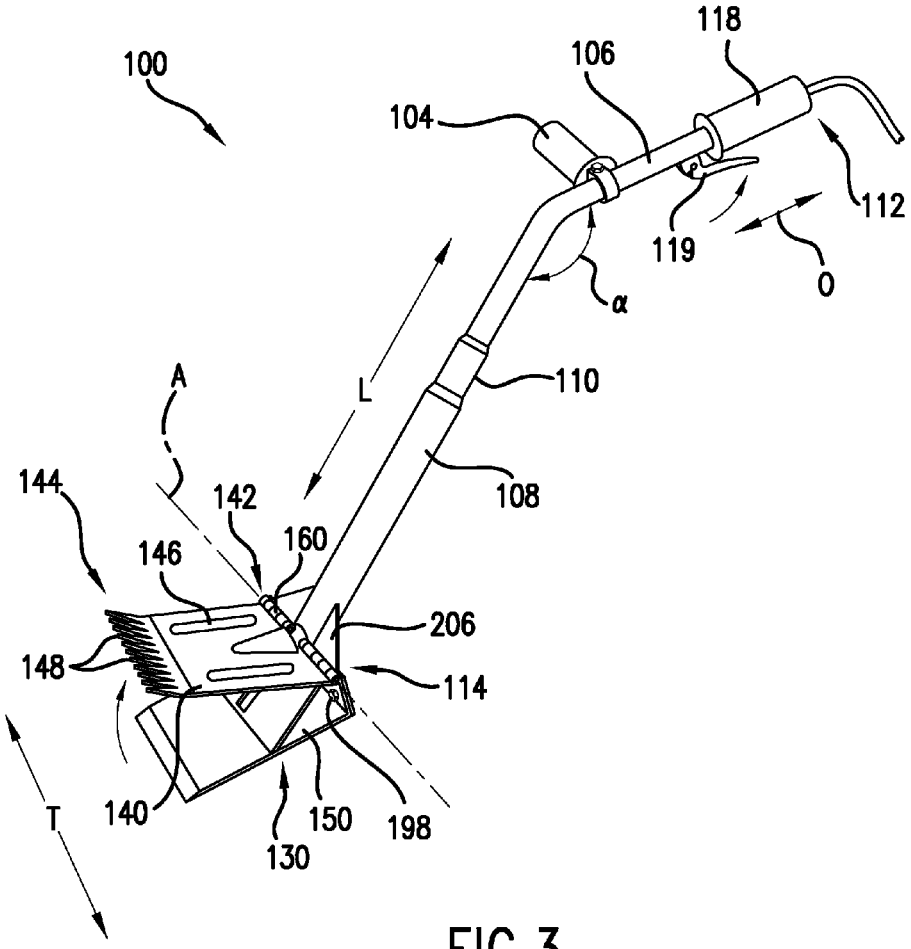
FIG. 3 provides a perspective view of the exemplary material removal tool of FIG. 1 with the blade of the exemplary material removal tool shown in a raised position.
Figure 4:
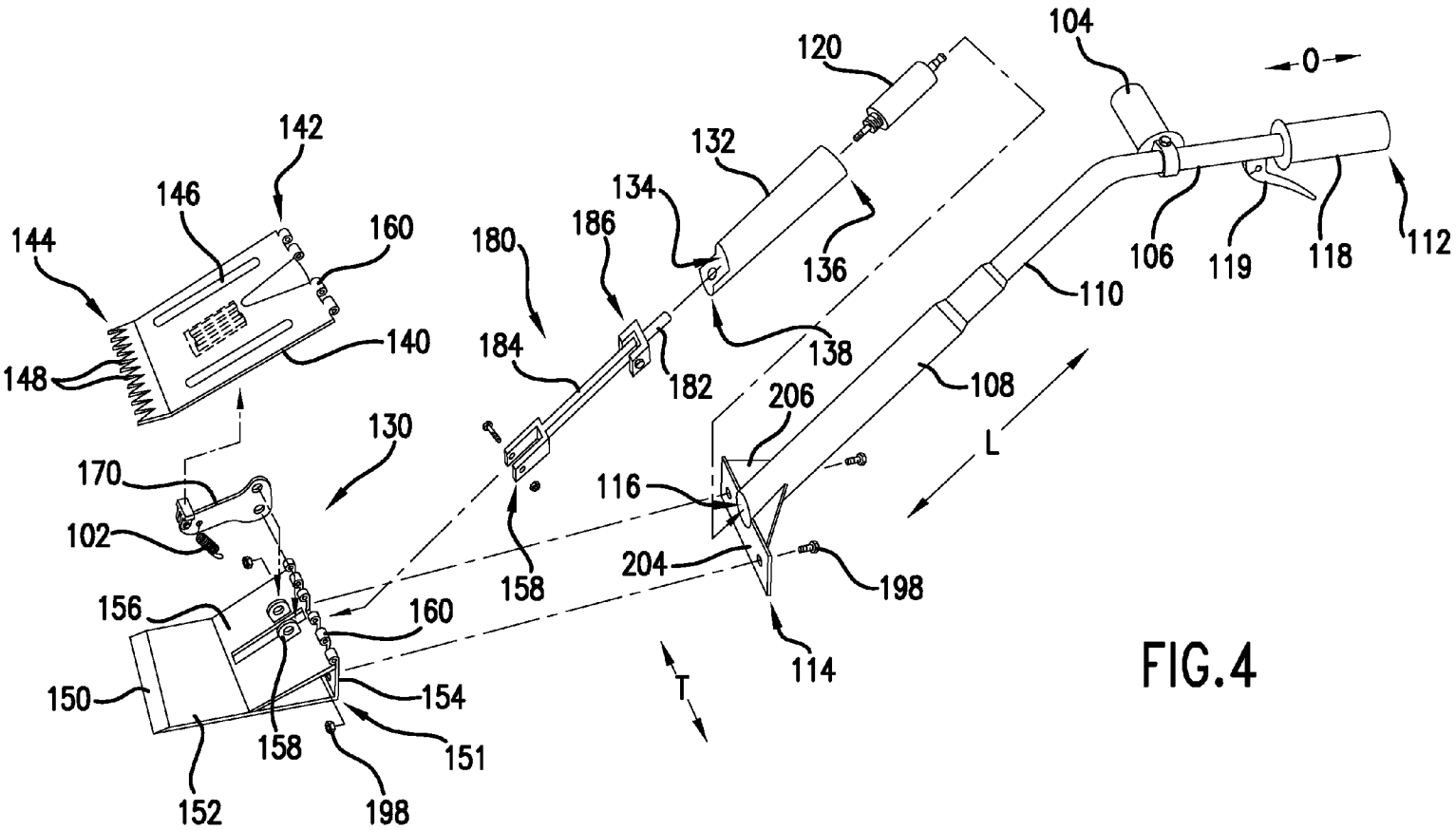
FIG. 4 provides an exploded view of the exemplary material removal tool of FIG. 1.

FIG. 2 provides a perspective view of material removal tool 100 with a blade 140 of material removal tool 100 shown in a lowered position. Conversely, FIG. 3 provides a perspective view of material removal tool 100 with blade 140 of material removal tool 100 shown in a raised position. As discussed in greater detail below, material removal tool 100 includes features for selectively adjusting or shifting blade 140 of material removal tool 100 between the lowered and raised position. By shifting blade 140 between the lowered and raised positions, a user can utilize material removal tool 100 to assist with removing material, such as shingles, from a surface, such as a roof FIG. 4 provides an exploded view of material removal tool 100.

Material removal tool 100 defines a longitudinal direction L and a transverse direction T. The longitudinal direction L and the transverse direction T are perpendicular to each other. Material removal tool 100 includes a handle 110. Handle 110 extends between a first end portion 112 and a second end portion 114, e.g., along the longitudinal direction L. Thus, first end portion 112 of handle 110 and second end portion 114 of handle 110 are spaced apart from each other, e.g., along the longitudinal direction L.

A grip 118 is positioned at first end portion 112 of handle 110. In particular, grip 118 is mounted to handle 110 at first end portion 112 of handle 110. A user can utilize or grasp grip 118 to assist the user with handling material removal tool 100. A trigger 119 is also positioned at first end portion 112 of handle 110, e.g., at or proximate grip 118. The user can utilize trigger 119 to selectively adjust blade 140 between the lowered and raised positions as discussed in greater detail below.

Material removal tool 100 also includes an auxiliary grip 104. Auxiliary grip 104 is positioned at or proximate first end portion 112 of handle 110. In particular, auxiliary grip 104 is mounted to handle 110, e.g., between grip 118 and second end portion 114 of handle 110 along the longitudinal direction L. A position and orientation of auxiliary grip 104 on handle 110 is selectively adjustable. As an example, a user can slide auxiliary grip 104 on handle 110 in order to adjust a position of auxiliary grip 104 relative to grip 118. Similarly, a user can rotate auxiliary grip 104 on handle 110 in order to adjust an orientation of auxiliary grip 104.

A material engagement assembly 130 of material removal tool 100 is positioned at second end portion 114 of handle 110. In particular, material engagement assembly 130 is mounted to handle 110 at second end portion 114 of handle 110, e.g., with fasteners 198. Material engagement assembly 130 includes blade 140. Thus, blade 140 is positioned at second end portion 114 of handle 110. In particular, blade 140 is mounted at second end portion 114 of handle 110 for pivoting relative to handle 110, e.g., between the lowered and raised positions shown in FIGS. 2 and 3, respectively.

Material engagement assembly 130 also includes a frame 150 and a hinge 160. Hinge 160 rotatably or pivotally mounts blade 140 to frame 150. In particular, hinge 160 rotatably or pivotally mounts blade 140 to frame 150 such that blade 140 is rotatable or pivotable on an axis of rotation A. The axis of rotation A of blade 140 may be substantially parallel to transverse direction T or substantially perpendicular to the longitudinal direction L.

Blade 140 is configured for engaging or contacting material to be removed by material removal tool 100. For example, turning back to FIG. 1, a user can position material removal tool 100 such that blade 140 is positioned beneath shingles 20. In particular, the user can position material removal tool 100 such that blade 140 is positioned between shingles 20 and roof 10. With blade 140 suitably positioned, the user can actuate material removal tool 100, e.g., using trigger 119, such that blade 140 is lifted from the lowered position shown in FIG. 2 to the raised position shown in FIG. 3. As blade 140 shifts to the raised position, blade 140 can lift shingles 20 and remove shingles 20 from roof 10. Material removal tool 100 includes features for shifting or moving blade 140 between the lowered position shown in FIG. 2 to the raised position shown in FIG. 3. Such features are discussed in greater detail below.

Turning back to FIG. 4, handle 110 defines a chamber 116, e.g., at second end portion 114 of handle 110. Chamber 116 can extend any suitable length along handle 110. For example, chamber 116 may extend between about first end portion 112 of handle 110 and about second end portion 114 of handle 110, e.g., along the longitudinal direction L. Thus, handle 110 may be, e.g., substantially, hollow.

Material removal tool 100 also includes a linear actuating mechanism 120. Linear actuating mechanism 120 is positioned within chamber 116 of handle 110. Thus, handle 110 receives linear actuating mechanism 120 therein, e.g., such that handle 110 encases or encloses linear actuating mechanism 120 in order to protect linear actuating mechanism 120 from debris, dirt, etc. In particular, linear actuating mechanism 120 is axially recessed within chamber 116 of handle 110, e.g., such that linear actuating mechanism 120 is protected by handle 110 from mechanical trauma, such as impact, from material that is located outside of or external to chamber 116 of handle 110.

Linear actuating mechanism 120 is configured for shifting or moving blade 140 between the lowered position shown in FIG. 2 to the raised position shown in FIG. 3. Linear actuating mechanism 120 may be any suitable mechanism for moving blade 140 between the lowered and raised positions. For example, linear actuating mechanism 120 may be a pneumatic cylinder, a hydraulic cylinder, a linear actuator, etc.

Material removal tool 100 also includes a cam 170. Cam 170 is rotatable relative to handle 110. Thus, cam 170 is rotatably mounted to another component of material removal tool 100. In the exemplary embodiment shown in FIGS. 2 and 3, cam 170 is rotatably mounted to frame 150 and blade 140. In alternative exemplary embodiments, cam 170 may be rotatably mounted to handle 110.

A linkage assembly 180, e.g., pivotally, couples linear actuating mechanism 120 to cam 170. In particular, linkage assembly 180 couples linear actuating mechanism 120 to cam 170 such that linear motion or extension of linear actuating mechanism 120 rotates or pivots blade 140 on the axis of rotation A. Thus, linkage assembly 180 extends between and connects linear actuating mechanism 120 and cam 170 such that blade 140 rotates or pivots between the lowered and raised positions when linear actuating mechanism 120 is activated.

In a similar manner to linear actuating mechanism 120, linkage assembly 180 and other moving components of material removal tool 100 are protected from damage from debris and other material. For example, by positioning linkage assembly 180 within chamber 116 of handle 110, handle 110 encases or encloses linkage assembly 180 and other moving components of material removal tool 100 in order to protect such components from mechanical trauma, e.g., due to impact or abrasion by debris, dirt, etc. Similarly, cam 170 is shielded from impact by debris and relatively large items by frame 150. In such a manner, moving components of material removal tool 100 can be shielded or protected from mechanical damage.

As may be seen FIG. 4, material engagement assembly 130 includes a post 132. Post 132 is receivable within chamber 116 of handle 110. Thus, post 132 can slide into chamber 116 of handle 110 in order to assist with mounting material engagement assembly 130 to handle 110. Post 132 extends between a first end portion 136 and a second end portion 138, e.g., along the longitudinal direction L. Thus, first and second end portions 136 and 138 of post 132 are spaced apart from each other, e.g., along the longitudinal direction L. Frame 150 is positioned at or proximate second end portion 138 of post 132. In particular, frame 150 is mounted to post 132 at second end portion 138 of post 132. Conversely, linear actuating mechanism 120 is positioned at or proximate first end portion 136 of post 132. In particular, linear actuating mechanism 120 is mounted to post 132 at first end portion 136 of post 132. For example, linear actuating mechanism 120 may be threaded onto post 132 at first end portion 136 of post 132. By mounting linear actuating mechanism 120 to post 132 in such a manner, linear actuating mechanism 120 can be easily replaced and/or serviced. In alternative exemplary embodiments, linear actuating mechanism 120 may be mounted to post 132 in any other suitable manner, e.g., using fasteners, adhesive, clips, etc.

Post 132 also defines a chamber 134. Chamber 134 of post 132 may extend between about first end portion 136 of post 132 and about second end portion 138 of post 132. Linkage assembly 180 is positioned within chamber 134 of post 132 and extends between linear actuating mechanism 120 and cam 170 within chamber 134 of post 132.

As may be seen in FIG. 4, frame 150 includes a base plate 152 and a back plate 154. Base plate 152 and back plate 154 are mounted to each other. In particular, base plate 152 extends between a proximal end portion 208 and a distal end portion 210. Back plate 154 is positioned proximate and mounted to base plate 152 at proximal end portion 208 of base plate 152. Base plate 152 and back plate 154 define a frame angle $\phi$ therebetween, e.g., in a plane that is perpendicular to the transverse direction T. Frame angle $\phi$ can be any suitable angle. For example, frame angle $\phi$ may be between about eighty degrees and about one hundred degrees or about ninety degrees.

A connecting plate 156 extends between and connects base plate 152 and back plate 154. A clevis 158 is positioned at and mounted to connecting plate 156. Cam 170 is rotatably mounted to frame 150 with clevis 158.

Frame 150 is mounted to handle 110 with back plate 154. In particular, back plate 154 of frame 150 can be positioned adjacent or on a butt plate 204 mounted to handle 110, e.g., at second end portion 114 of handle 110. Fasteners 198 can extend through back plate 154 of frame 150 and butt plate 204 of handle 110 in order to couple or connect back plate 154 of frame 150 and butt plate 204 of handle 110 together. Braces or brackets 206 can assist with supporting butt plate 204 at second end portion 114 of handle 110. In particular, brackets 206 can extend between and connect butt plate 204 and handle 110 at second end portion 114 of handle 110.

Material removal tool 100 also includes features for assisting or improving ergonomics of a user. For example, handle 110 includes a first portion 106 and a second portion 108. First and second portions 106 and 108 of handle 110 define a handle angle $\alpha$ therebetween. Handle angle $\alpha$ can be any suitable angle. For example, handle angle $\alpha$ may be between about, one hundred degrees and about one hundred and seventy degrees, or handle angle $\alpha$ may be between about one hundred and twenty-five degrees and about one hundred and forty-five degrees. In particular, handle angle $\alpha$ may be about one hundred and thirty-five degrees.

Grip 118 is positioned at or on first portion 106 of handle 110. Conversely, material engagement assembly 130, e.g., frame 150, is positioned at or on second portion 108 of handle 110. Grip 118 is oriented such that grip 118 is substantially perpendicular to a normal line N extending from a bottom surface 212 of base plate 152, e.g., along a lateral direction O defined by grip 118. Thus, the lateral direction O of grip 118 may be substantially perpendicular to the normal line N of base plate 152. Orientation of grip 118 relative to base plate 152 and/or handle angle a between first and second portions 106 and 108 of handle 110 can permit a user of material removal tool 100 to handle or grasp material removal tool 100 in an ergonomic manner, e.g., such that the user avoids injuries, such as back or hand injuries. In particular, the user can avoid excessive bending or stooping while operating material removal tool 100 to remove shingles from a roof.

Figure 5:
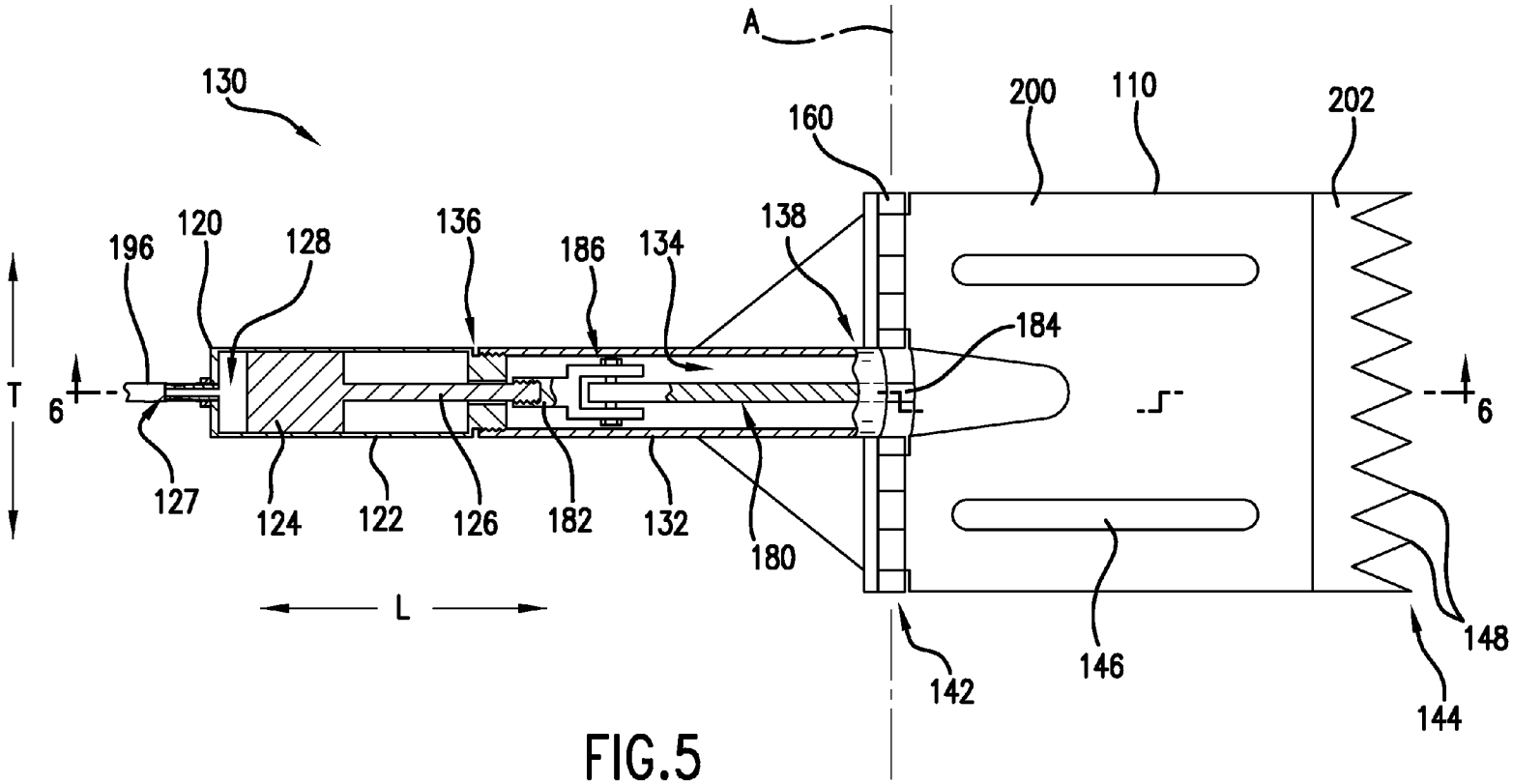
FIG. 5 provides a partial, section view of the exemplary material removal tool of FIG. 1 at a second end portion of a handle of the exemplary material removal tool.
Figure 6:
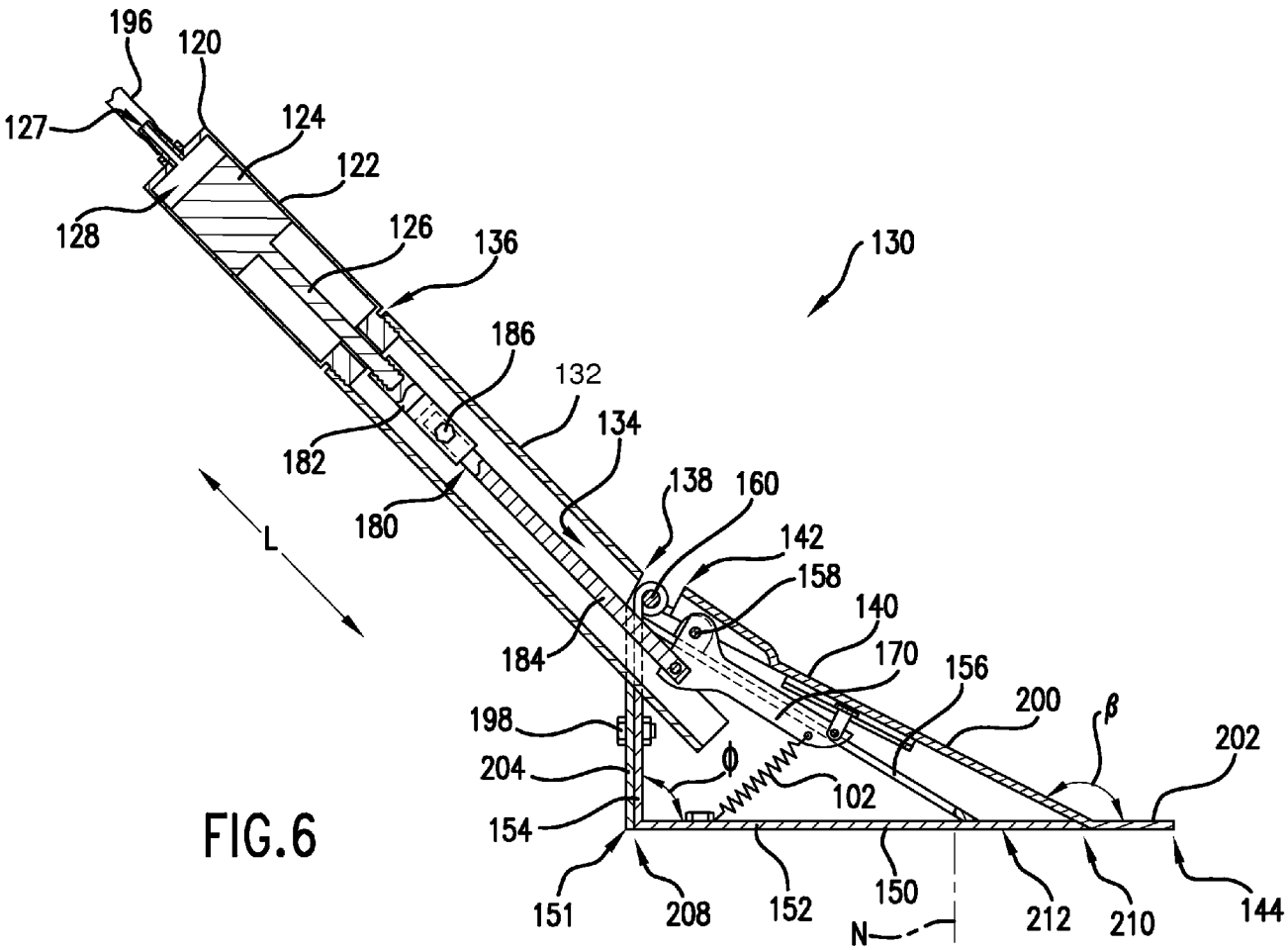
FIG. 6 provides a partial, section view of the exemplary material removal tool of FIG. 5 taken along the 6-6 line of FIG. 5.

FIG. 5 provides a section view of material engagement assembly 130. FIG. 6 provides a section view of material engagement assembly 130 taken along the 6-6 line of FIG. 5. In the exemplary embodiment shown in FIGS. 5 and 6, linear actuating mechanism 120 includes a barrel 122 that defines a volume 128. A piston 124 of linear actuating mechanism 120 is positioned within volume 128. Barrel 122 also defines an inlet 127. Inlet 127 can received a fluid, such a compressed air or oil, and direct such fluid into volume 128. Such fluid can urge piston 124 within volume 128 to slide within barrel 122, e.g., along the longitudinal direction L. Piston 124 is coupled or connected to a rod 126. Thus, as piston 124 slides within barrel 122, rod 126 also moves, e.g., linearly along the longitudinal direction L.

Rod 126 of linear actuating mechanism 120 is coupled or connected to linkage assembly 180. In particular, linkage assembly 180 includes a first linkage 182 and a second linkage 184 coupled or connected to each other. First linkage 182 is mounted to rod 126. In turn, second linkage 184 is, e.g., rotatably, mounted to first linkage 182, e.g., with a clevis 186, and/or cam 170.

As discussed above, cam 170 is rotatable relative to handle 110, e.g., in a plane that is perpendicular to the transverse direction T. In the exemplary embodiment shown in FIG. 5, cam 170 is rotatably mounted to blade 140, frame 150, and linkage assembly 180. Thus, linkage assembly 180 couples linear actuating mechanism 120 and cam 170 together such that linear motion of linear actuating mechanism 120 pivots blade 140 relative to handle 110, e.g., on the axis of rotation A between the raised and lowered position. Such motion of blade 140 is discussed in greater detail below.

As may be seen in FIG. 5, blade 140 extends between a proximal end portion 142 and a distal end portion 144, e.g., along the longitudinal direction L. Proximal end portion 142 of blade 140 is positioned at or adjacent hinge 160. Conversely, distal end portion 144 of blade 140 is spaced apart from hinge 160, e.g., along the longitudinal direction L. Blade 140 defines a plurality of support ribs 146 thereon. Ribs 146 extend between about the proximal and distal end portions 142 and 144 of blade 140, e.g., along the longitudinal direction L. Support ribs 146 can assist with hindering deflection of blade 140 by stiffening blade 140.

Blade 140 also defines a plurality of teeth 148, e.g., at distal end portion 144 of blade 140. Teeth 148 are spaced apart from each other, e.g., along the transverse direction T. Teeth 148 can be spaced apart from each other by a distance, e.g., between about one-quarter of an inch and one-half of an inch, in order to receive nails and other fasteners therebetween. During movement of blade 140 between the lowered and raised positions, teeth 148 can assist blade 140 with lifting such fasteners upwardly and removing such fasteners from a surface, such as roof 10 (FIG. 1). In such a manner, material removal tool 100, e.g., blade 140, can remove shingles and fasteners simultaneously without damaging an underlying roof.

Figure 7:
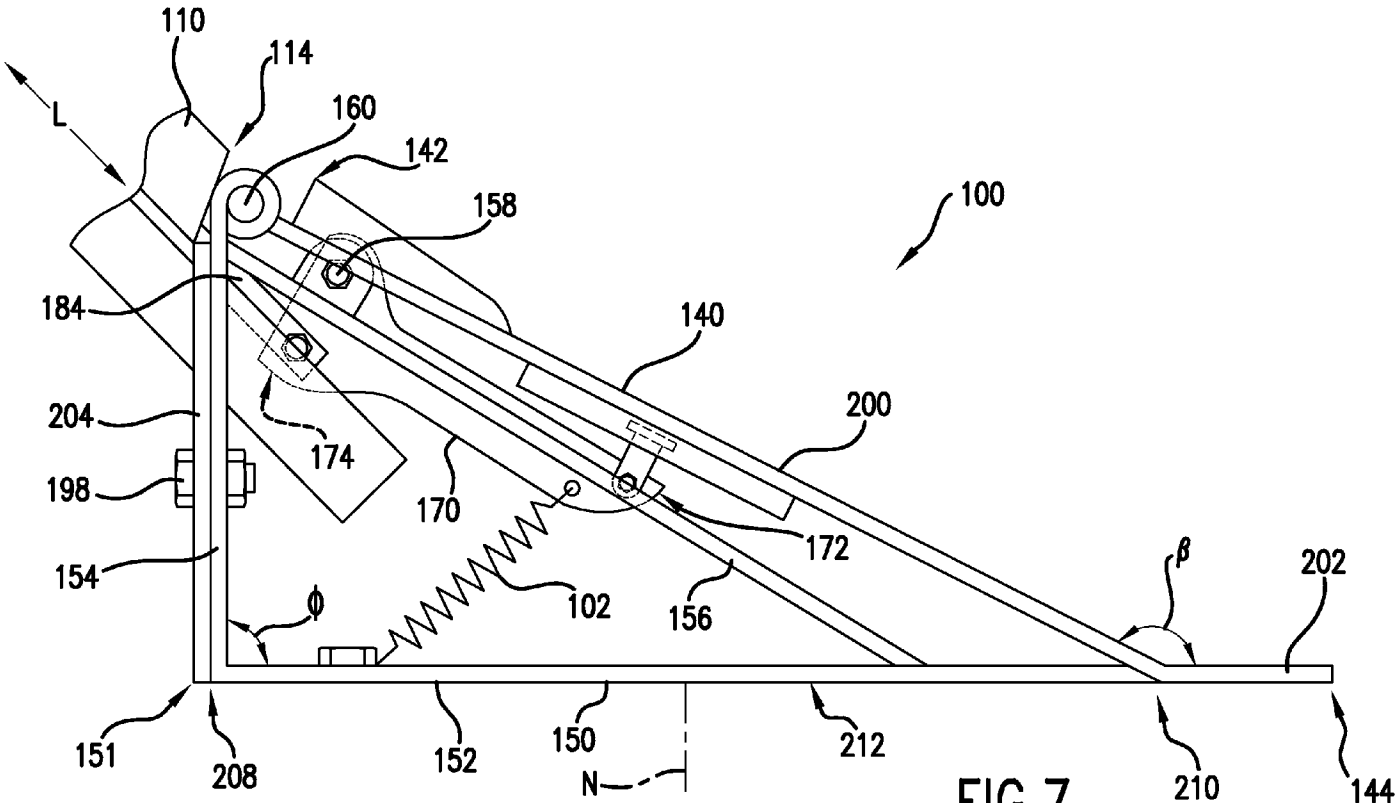
FIG. 7 provides a partial, elevation view of the exemplary material removal tool of FIG. 1 with the blade of the exemplary material removal tool shown in the lowered position.
Figure 8:
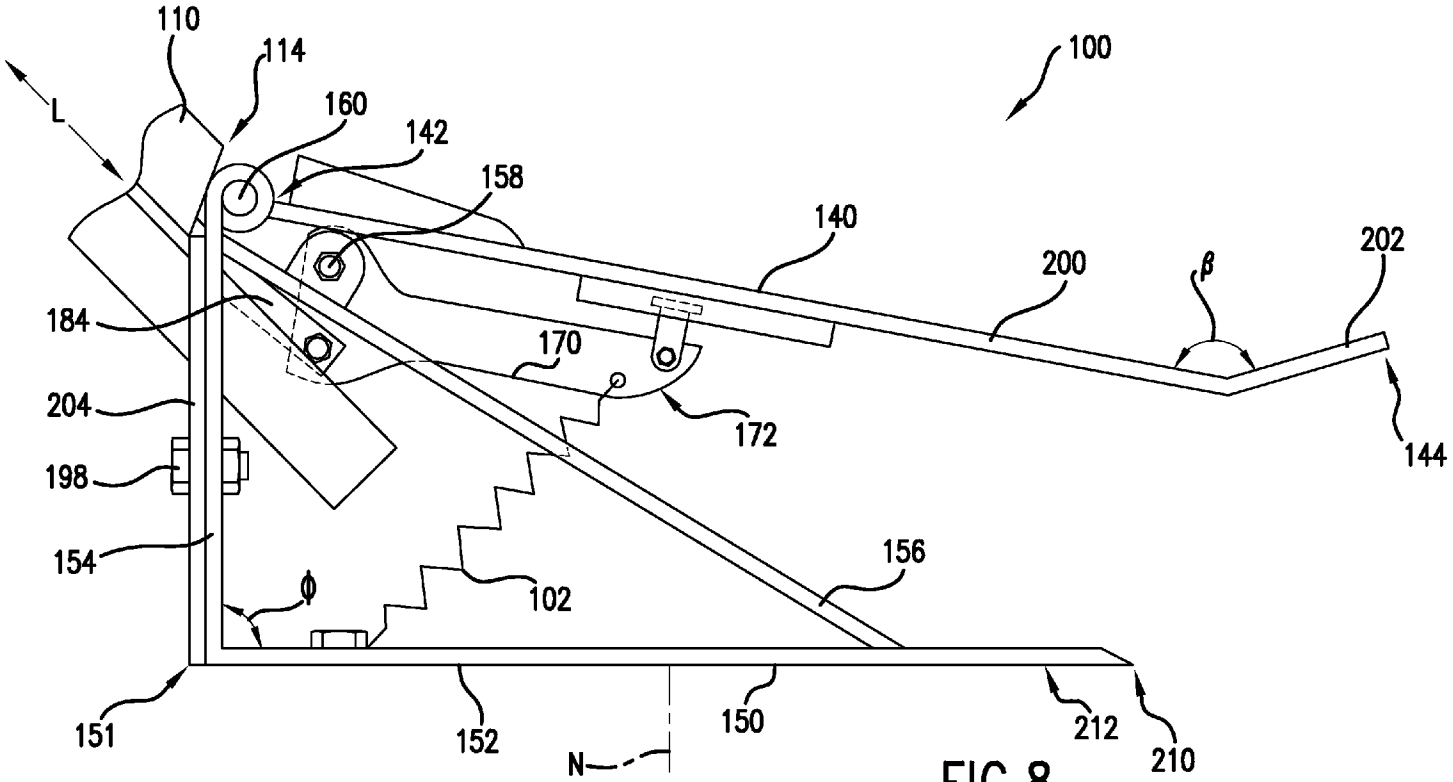
FIG. 8 provides a partial, elevation view of the exemplary material removal tool of FIG. 1 with the blade of the exemplary material removal tool shown in the raised position.

FIG. 7 provides a partial, elevation view of material removal tool 100 at second end portion 114 of handle 110 with blade 140 of material removal tool 100 shown in the lowered position. FIG. 8 provides a partial, elevation view of material removal tool 100 at second end portion 114 of handle 110 with blade 140 of material removal tool 100 shown in the raised position. Operation of material removal tool 100 and movement or pivoting of blade 140 between the lowered and raised positions is discussed in greater detail below.

As discussed above, a user can utilize trigger 119 (FIG. 2) to activate linear actuating mechanism 120 (FIG. 4) and extend rod 126 (FIG. 4) of linear actuating mechanism 120. For example, trigger 119 can activate a valve 214 (FIG. 9) within handle 110 to supply air to linear actuating mechanism 120 such that linear actuating mechanism 120 extends rod 126. In turn, linkage assembly 180 transfers motion of linear actuating mechanism 120 to cam 170. As schematically shown in FIGS. 7 and 8 for example, cam 170 includes features for pivoting blade 140 due to linear motion of linear actuating mechanism 120. In particular, cam 170 has a first leg 172 and a second leg 174. First and second legs 172 and 174 of cam 170 are spaced apart from each other, e.g., along the longitudinal direction L. First leg 172 of cam 170 is, e.g., rotatably, mounted to blade 140. Conversely, second leg 174 of cam 170 is, e.g., rotatably, mounted to linkage assembly 180, e.g., second linkage 184 of linkage assembly 180. Between first and second legs 172 and 174 of cam 170, cam 170 is also rotatably mounted to frame 150 and/or handle 110. Thus, when a user activates linear actuating mechanism 120, cam 170 can pivot on frame 150 relative to handle 110, e.g., such that linear motion of linear actuating mechanism 120 pivots blade 140 relative to handle 110 on the axis of rotation A.

Material removal tool 100 also includes a biasing mechanism 102. Biasing mechanism 102 urges blade 140 towards the lowered position. For example, biasing mechanism 102 can assist with lowering blade 140 from the raised position shown in FIG. 8 to the lowered position shown in FIG. 7. Biasing mechanism 102 can be any suitable mechanism for urging blade 140 towards the lowered position. For example, biasing mechanism 102 may be a spring, such as a coil spring or gas spring, as shown in FIGS. 7 and 8 that extends between frame 150 and cam 170 or blade 140 and pulls blade 140 downwardly towards the lowered position.

As may be seen in FIGS. 7 and 8, blade 140 includes a first portion 200 and a second portion 202. First and second portions 200 and 202 of blade 140 define a blade angle β therebetween, e.g., in a plane that is perpendicular to the transverse direction T. Blade angle β can be any suitable angle. For example, blade angle β may be between about one hundred and seventy-five degrees and about one hundred and thirty-five degrees or about one hundred and fifty-five degrees. Blade angle β can assist with sliding of blade 140 beneath shingles and other materials. For example, blade angle β can permit second portion 202 of blade 140 to be substantially parallel to and ride on an underlying surface below the material to be removed. Such positioning can assist sliding of blade 140 beneath the material to be removed.

Figure 9:
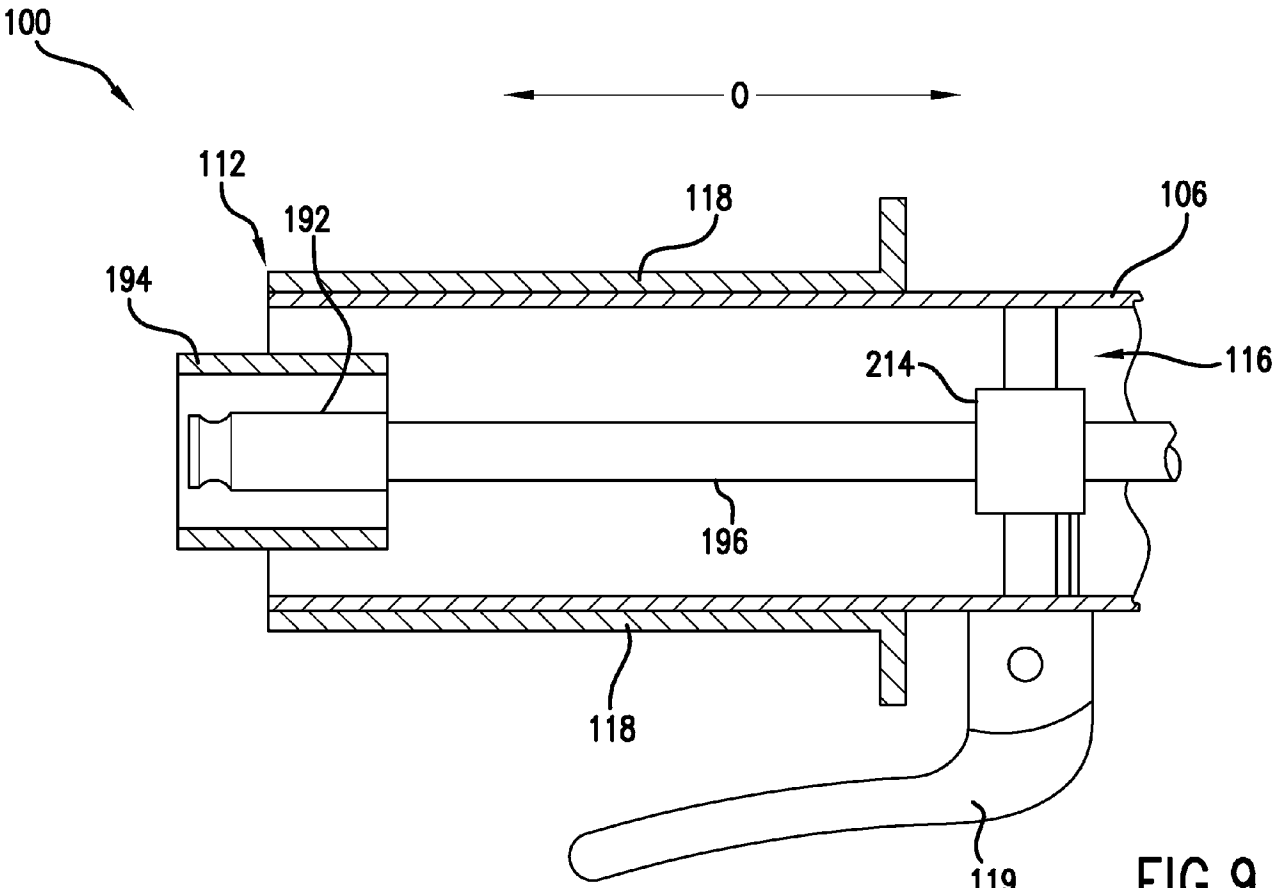
FIG. 9 provides a partial, section view of the exemplary material removal tool of FIG. 1 at a first end portion of the handle of the exemplary material removal tool.

FIG. 9 provides a partial, section view of material removal tool 100. In particular, FIG. 9 provides a partial, section view of handle 110 of material removal tool 100 at first end portion 112 of handle 110. As may be seen in FIG. 9, material removal tool 100 includes a connection 192, e.g., at or proximate first end portion 112 of handle 110 or grip 118. Connection 192 can engage a power source (not shown) for linear actuating mechanism 120. For example, an air hose (not shown) connected to an air compressor (not shown) may engage connection 192 and supply compressed air for operation of linear actuating mechanism 120 (FIG. 5).

As schematically shown in FIG. 9 for example, a conduit 196 extends between connection 192 and linear actuating mechanism 120. Conduit 196 can couple or connect connection 192 and linear actuating mechanism 120 together, e.g., in order to power or permit operation of linear actuating mechanism 120. Conduit 196 is positioned within handle 110, e.g., within chamber 116 of handle 110. Conduit 196 can also couple or connect valve 214 to connection 192 and/or linear actuating mechanism 120.

To protect connector 192, material removal tool 100 also includes a sleeve or shield 194. Shield 194 is mounted to handle 110, e.g., at first end portion 112 of handle 110. Connector 192 is positioned within shield 194. For example, shield 194 can extend around connector 192, e.g., in a plane that is perpendicular to the lateral direction O of grip 118. In such a manner, shield 194 can protect connector 192, e.g., by preventing debris and other materials from impacting and potentially damaging connector 192.

It should be understood that although described above with linear actuating mechanism 120 assisting removal of material, material removal tool 100 can be used to manually remove material from a surface without assistance of linear actuating mechanism 120. For example, in FIG. 1, a user can utilize material removal tool 100 in a similar manner to a shovel to remove shingles 20 from roof 10. In particular, frame 150 can define a pivot 151, e.g., where base plate 152 and back plate 154 connect. A user can utilize material removal tool 100 as a lever to pry shingles 20 from roof 10 by resting pivot 151 of frame 150 on roof 110 and pushing downwardly on first end portion 112 of handle 110, e.g., at grip 118, such that distal end portion 210 of blade 140 rises upwardly. Thus, material removal tool 100 need not be powered in order to remove material from a surface, or such motion can assist material removal due to rotation or pivoting of blade 140 by linear actuating mechanism 120.

Material removal tool 100 can be constructed with various materials. In particular, handle 110 may be constructed from steel or aluminum, and blade 140 may be constructed from steel. Such materials can provide a relatively light tool that can be carried up to roof 10 in one hand. In addition, the simple design of material removal tool 100 can permit material removal tool 100 to be produced and sold cheaply such that material removal tool 100 is an efficient and affordable option to increase productivity of user 1 relative to manual tools, such as a simple shovel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A material removal tool defining a longitudinal direction and a transverse direction, the longitudinal and transverse directions being perpendicular to each other, the material removal tool comprising:

a handle that extends between a first end portion and a second end portion along the longitudinal direction, the handle defining a chamber at the second end portion of the handle;

a linear actuating mechanism positioned within the chamber of the handle;

a material engagement assembly mounted to the handle at the second end portion of the handle, the material engagement assembly comprising a blade;

a frame; and a hinge rotatably mounting the blade to the frame such that the blade is rotatable on an axis of rotation, the axis of rotation being substantially parallel to the transverse direction;

a cam rotatably mounted to the frame; and a linkage assembly coupling the linear actuating mechanism to the cam such that linear motion of the linear actuating mechanism rotates the blade on the axis of rotation.

2. The material removal tool of claim 1, wherein the linear actuating mechanism comprises a pneumatic cylinder.

3. The material removal tool of claim 1, wherein the material engagement assembly further comprises a post, the post received within the chamber of the handle, the post extending between a first end portion and a second end portion along the longitudinal direction, the frame mounted to the post at the second end portion of the post, the linear actuating mechanism mounted to the post at the first end portion of the post, the post defining a chamber, the linkage assembly positioned within the chamber of the post.

4. The material removal tool of claim 3, wherein the linear actuating mechanism is threaded onto the post at the first end portion of the post.

5. The material removal tool of claim 1, wherein the frame comprises a base plate and a back plate, the base plate extending between a proximal end portion and a distal end portion, the back plate mounted to the base plate at the proximal end portion of the base plate.

6. The material removal tool of claim 5, further comprising a grip mounted to the handle at the first end portion of the handle, the grip being oriented such that the grip is substantially perpendicular to a normal line extending from a bottom surface of the base plate along a lateral direction of the grip.

7. The material removal tool of claim 1, further comprising:

a grip mounted to the handle at the first end portion of the handle; and a connection for the linear actuating mechanism positioned at the first end portion of the handle.

8. The material removal tool of claim 7, further comprising a conduit extending between the connection for the linear actuating mechanism and the linear actuating mechanism, the conduit positioned within the chamber of the handle.

9. The material removal tool of claim 1, wherein the blade extends between a proximal end portion and a distal end portion, the proximal end portion of the blade being positioned adjacent the hinge, the blade defining a plurality of support ribs extending between about the proximal end portion of the blade and the distal end portion of the blade.

10. The material removal tool of claim 1, wherein the blade extends between a proximal end portion and a distal end portion, the proximal end portion of the blade being positioned adjacent the hinge, the distal end portion of the blade defining a plurality of teeth, the plurality of teeth being spaced apart from each other along the transverse direction.

11. A material removal tool defining a longitudinal direction and a transverse direction, the longitudinal and transverse directions being perpendicular to each other, the material removal tool comprising:

a handle having a first end portion and a second end portion, the first and second end portions of the handle being spaced apart from each other along the longitudinal direction, the handle defining a chamber at the second end portion of the handle;

a linear actuating mechanism positioned within the chamber of the handle;

a blade positioned at the second end portion of the handle, the blade mounted for pivoting relative to the handle;

a cam positioned at the second end portion of the handle, the cam being rotatable in a plane that is perpendicular to the transverse direction, the cam having a first leg and a second leg that are spaced apart from each other, the first leg of the cam being mounted to the blade; and a linkage assembly coupling the linear actuating mechanism and the second leg of the cam together such that linear motion of the linear actuating mechanism pivots the blade relative to the handle.

12. The material removal tool of claim 11, wherein the linear actuating mechanism comprises a pneumatic cylinder.

13. The material removal tool of claim 11, further comprising:

a frame;

a hinge rotatably mounting the blade to the frame such that the blade is rotatable on an axis of rotation, the axis of rotation being substantially parallel to the transverse direction; and a post received within the chamber of the handle, the post extending between a first end portion and a second end portion along the longitudinal direction, the frame mounted to the post at the second end portion of the post, the linear actuating mechanism mounted to the post at the first end portion of the post, the post defining a chamber, the linkage assembly positioned within the chamber of the post.

14. The material removal tool of claim 13, wherein the linear actuating mechanism is threaded onto the post at the first end portion of the post.

15. The material removal tool of claim 13, wherein the frame comprises a base plate and a back plate, the base plate extending between a proximal end portion and a distal end portion, the back plate mounted to the base plate at the proximal end portion of the base plate.

16. The material removal tool of claim 15, further comprising a grip mounted to the handle at the first end portion of the handle, the grip being oriented such that the grip is substantially perpendicular to a normal line extending from a bottom surface of the base plate along a lateral direction of the grip.

17. The material removal tool of claim 11, further comprising:

a grip mounted to the handle at the first end portion of the handle; and a connection for the linear actuating mechanism positioned at the first end portion of the handle.

18. The material removal tool of claim 17, further comprising a conduit extending between the connection for the linear actuating mechanism and the linear actuating mechanism, the conduit positioned within the chamber of the handle.

19. The material removal tool of claim 11, wherein the blade extends between a proximal end portion and a distal end portion, the proximal end portion of the blade being positioned adjacent the second end portion of the handle, the blade defining a plurality of support ribs extending between about the proximal end portion of the blade and the distal end portion of the blade.

20. The material removal tool of claim 11, wherein the blade extends between a proximal end portion and a distal end portion, the proximal end portion of the blade being positioned adjacent the second end portion of the handle, the distal end portion of the blade defining a plurality of teeth, the plurality of teeth being spaced apart from each other along the transverse direction.

* * * * *